US005579598A

United States Patent [19]

Fallon et al.

[11] Patent Number: 5,579,598

[45] Date of Patent: Dec. 3, 1996

[54] LUMINOUS ELECTRIC SIGN

[75] Inventors: Timothy R. Fallon, Columbia; Walter K. Tanner, Jr., Chesnee, both of S.C.

[73] Assignee: Fallon Luminous Products Corporation, Spartanburg, S.C.

[21] Appl. No.: 528,258

[22] Filed: Sep. 13, 1995

Related U.S. Application Data

[62] Division of Ser. No. 262,007, Jun. 17, 1994, Pat. No. 5,533,286.

[51] Int. Cl.[6] ..... G09F 13/26

[52] U.S. Cl. ..... 40/545; 40/546; 362/31; 362/812

[58] Field of Search ..... 40/545, 546; 362/351, 362/26, 33, 97, 812

[56] References Cited

U.S. PATENT DOCUMENTS

| | | | |
|---|---|---|---|
| 1,570,980 | 1/1926 | Wiegand . | |
| 1,654,255 | 12/1927 | Hendry . | |
| 1,872,428 | 8/1932 | Drury . | |
| 1,875,307 | 8/1932 | Lockwood | 40/545 |
| 1,888,366 | 11/1932 | Willens | 40/545 |
| 1,917,956 | 7/1933 | Earley . | |
| 2,082,523 | 6/1937 | Segal . | |
| 2,566,458 | 9/1951 | Macan | 40/546 |
| 2,763,948 | 9/1956 | Hilgedick . | |
| 2,917,838 | 12/1959 | Neugass | 40/546 X |
| 3,085,224 | 4/1963 | Becka . | |
| 4,903,172 | 2/1990 | Schoniger et al. . | |
| 5,267,404 | 12/1993 | Kizy . | |
| 5,270,910 | 12/1993 | Kile | 40/545 X |

FOREIGN PATENT DOCUMENTS

| | | | |
|---|---|---|---|
| 643105 | 9/1950 | United Kingdom | 40/546 |

*Primary Examiner*—Brian K. Green
*Attorney, Agent, or Firm*—Hardaway Law Firm P.A.

[57] ABSTRACT

An electric luminous display unit for conveying visual information including a housing comprising an opaque front face portion of substantially rigid molded plastic, an elongated groove in the front face portion of the housing, inert gas-containing glass tubing located in the groove and extending therealong, and electrical means located behind the front face portion of the housing and electrically connected to ends of the glass tubing for supplying electrical energy to illuminate the same. In one embodiment, an edge-lighted board is described for receiving written information thereon.

5 Claims, 5 Drawing Sheets

LUMINOUS ELECTRIC SIGN

This application is a division, of application Ser. No. 08/262,007, filed Jun. 17, 1994, now U.S. Pat. No. 5,533, 286.

This invention relates to a luminous electric display unit of the inert gas-containing tube type and, more particularly, to such a display unit having an improved housing of simple and economical construction for supporting and protecting the lighting and electrical components of the sign.

BACKGROUND OF THE INVENTION

Luminous electric signs of the inert gas-filled tube type have long been employed in commercial and business establishments to provide decoration and/or impart information. Typically, such signs are referred to as "neon signs" and may be hung or placed in various locations, such as store-front windows, to advertise a product, decorate, or provide message information.

The tubular lighting elements of the sign may be conformed into an array of desired letters or decorative shapes, as in a glass tube-bending operation, and the array is supportably attached by suitable brackets or wires to a rigid open frame, to a support backing, or in some form of housing or box.

In luminous signs of the neon tube type, it is desirable to protect the glass tubular lighting array from breakage, and to protect the various elements of the sign from collecting dust, foreign particles, and the like. In daylight conditions, it is often desirable that the lighted tubular array be backed by an opaque material for light containment and to provide solid background for better visibility of the sign.

It is also known to provide luminous electric display units, typically called electric blackboards, wherein a fluorescent or photoconductive plate, such as an acrylic plastic board, is edge lighted by a light-emitting element to concentrate light in the board whereby hand written information placed thereon by suitable means, such as water-soluble erasable high-pigment crayons has a glow or brightness to display the information contained on the board.

Luminous electric display units of the types described are disclosed in the following U.S. patents:

| | |
|---|---|
| U.S. Pat. No. 1,654,255 | U.S. Pat. No. 2,082,523 |
| U.S. Pat. No. 2,763,948 | U.S. Pat. No. 3,085,224 |
| U.S. Pat. No. 4,903,172 | |

BRIEF OBJECTS OF THE PRESENT INVENTION

It is an object of the present invention to provide a luminous electric display unit of the inert gas-filled tube type having a support housing for the lighting array and electrical components of the unit which is of simplified and economical construction.

It is another object to provide a luminous electric display unit which protects the lighting array and electrical elements of the unit against glass breakage and contamination by dust and foreign matter.

It is a further object to provide a display unit having an improved support housing for the electrical and lighting elements of the unit to provide high visibility to the lighting elements.

It is a more specific object, in one form of the invention, to provide a luminous electric display unit having an edge-lighted message board, and a back-lighted portion to display information apart from the edge-lighted message board.

BRIEF DESCRIPTION OF THE DRAWINGS

The above as well as other objects of the invention will become more apparent, and the invention will be better understood, from the following detailed description of preferred embodiments of the invention, when taken together with the accompanying drawings, in which.

Figure 1:
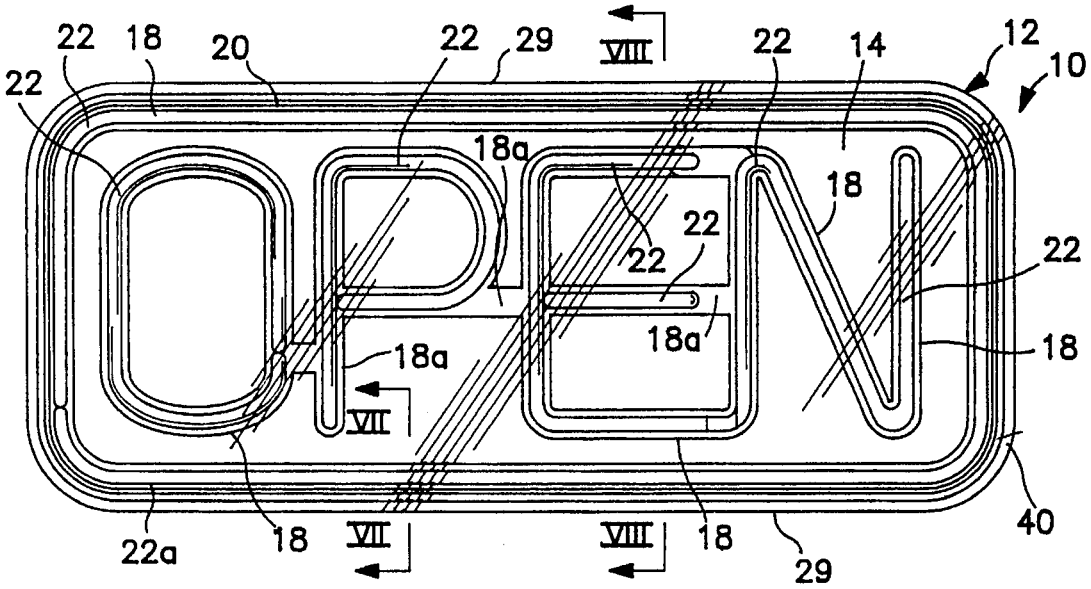
FIG. 1 is a front elevation view of a first embodiment of an electric luminous display unit of the present invention.
Figure 2:
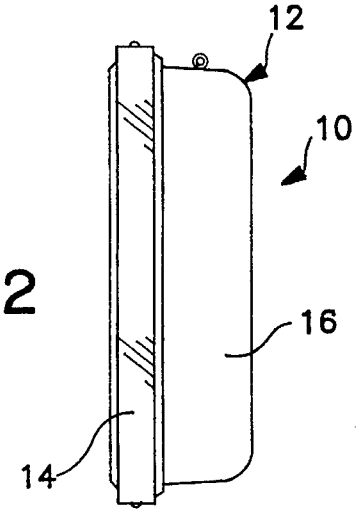
FIG. 2 is a right side elevation view of the display unit of FIG. 1.
Figure 8:
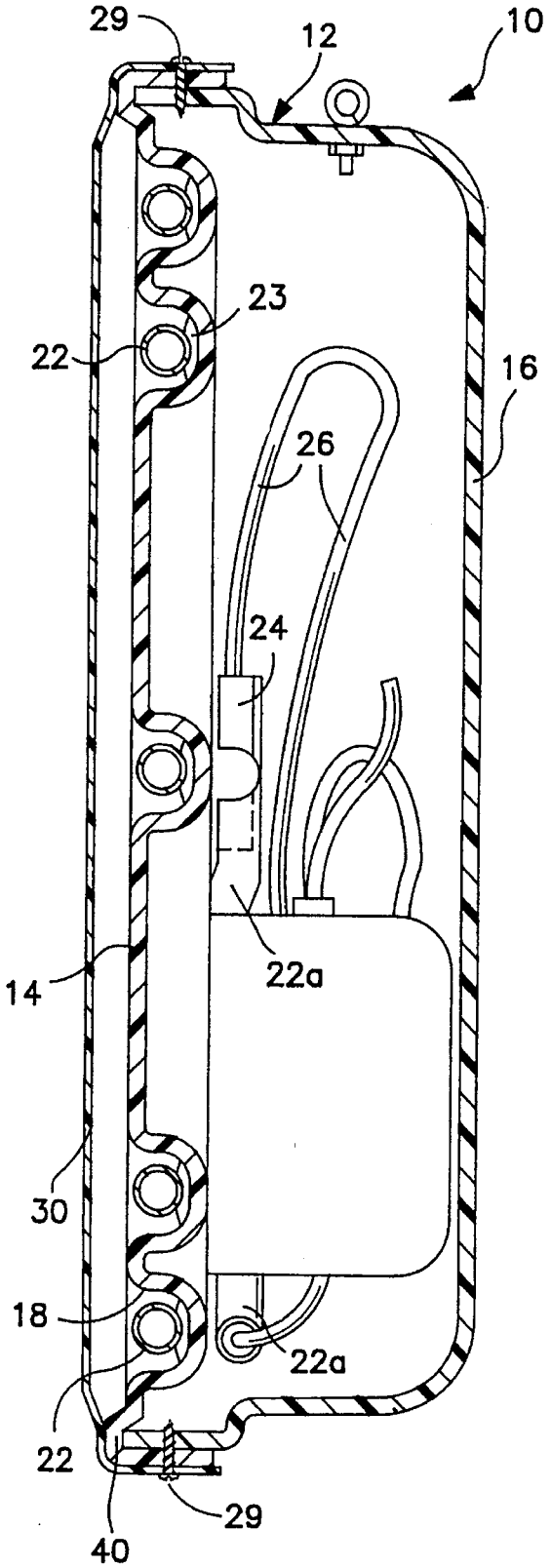
Figure 9:
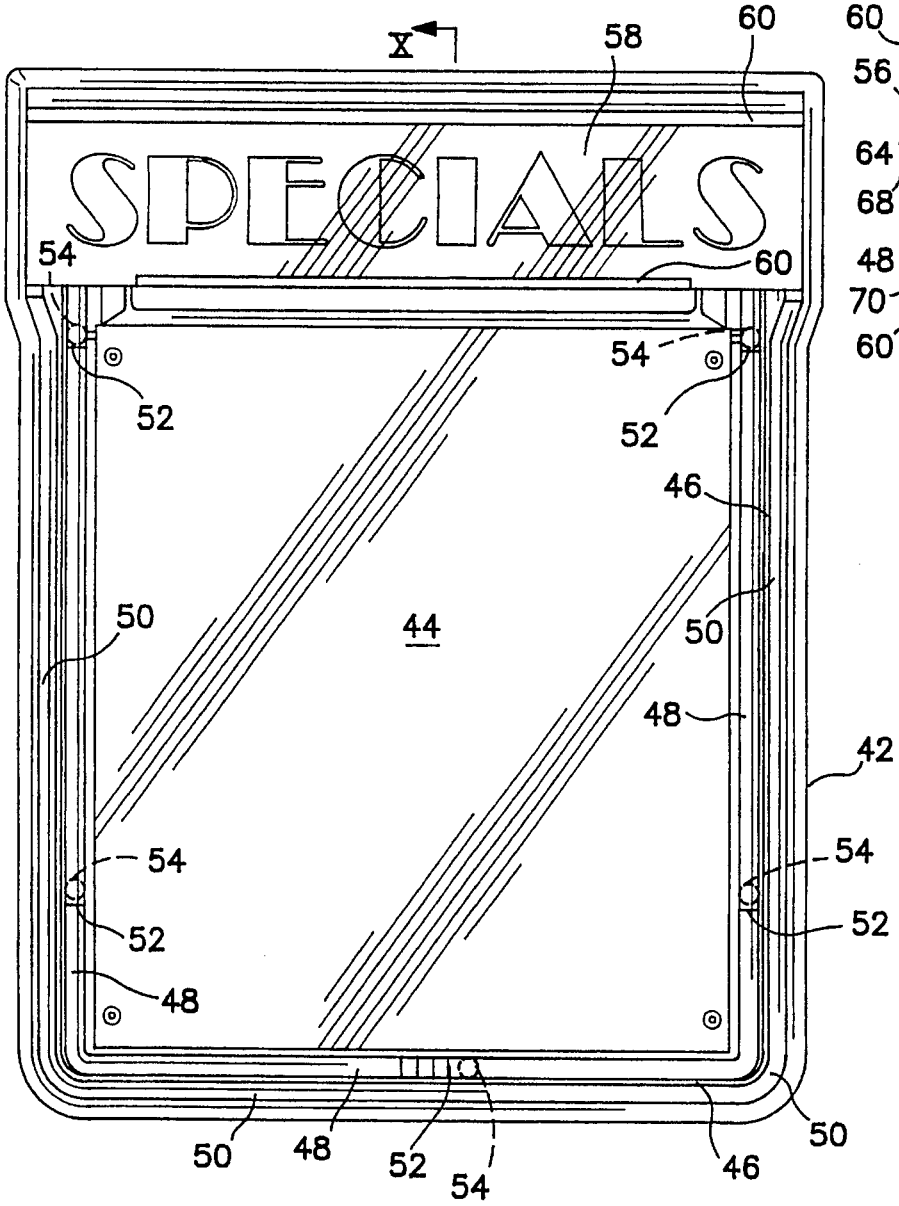
Figure 10:
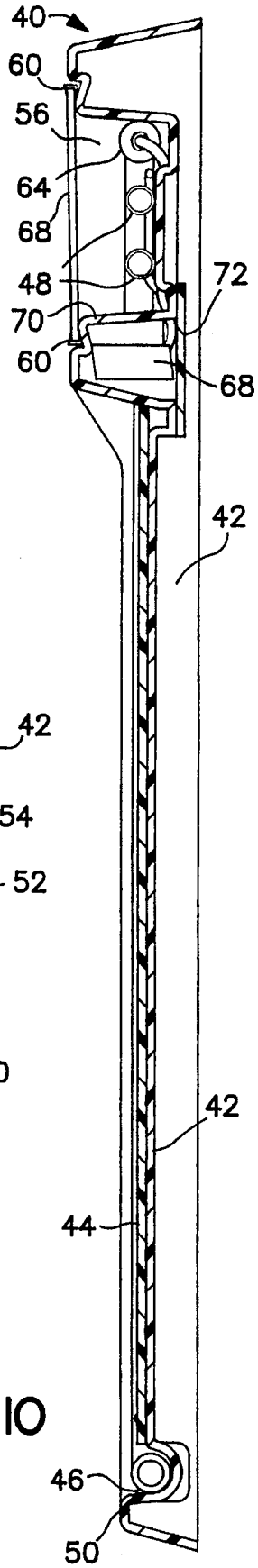
Figure 11:
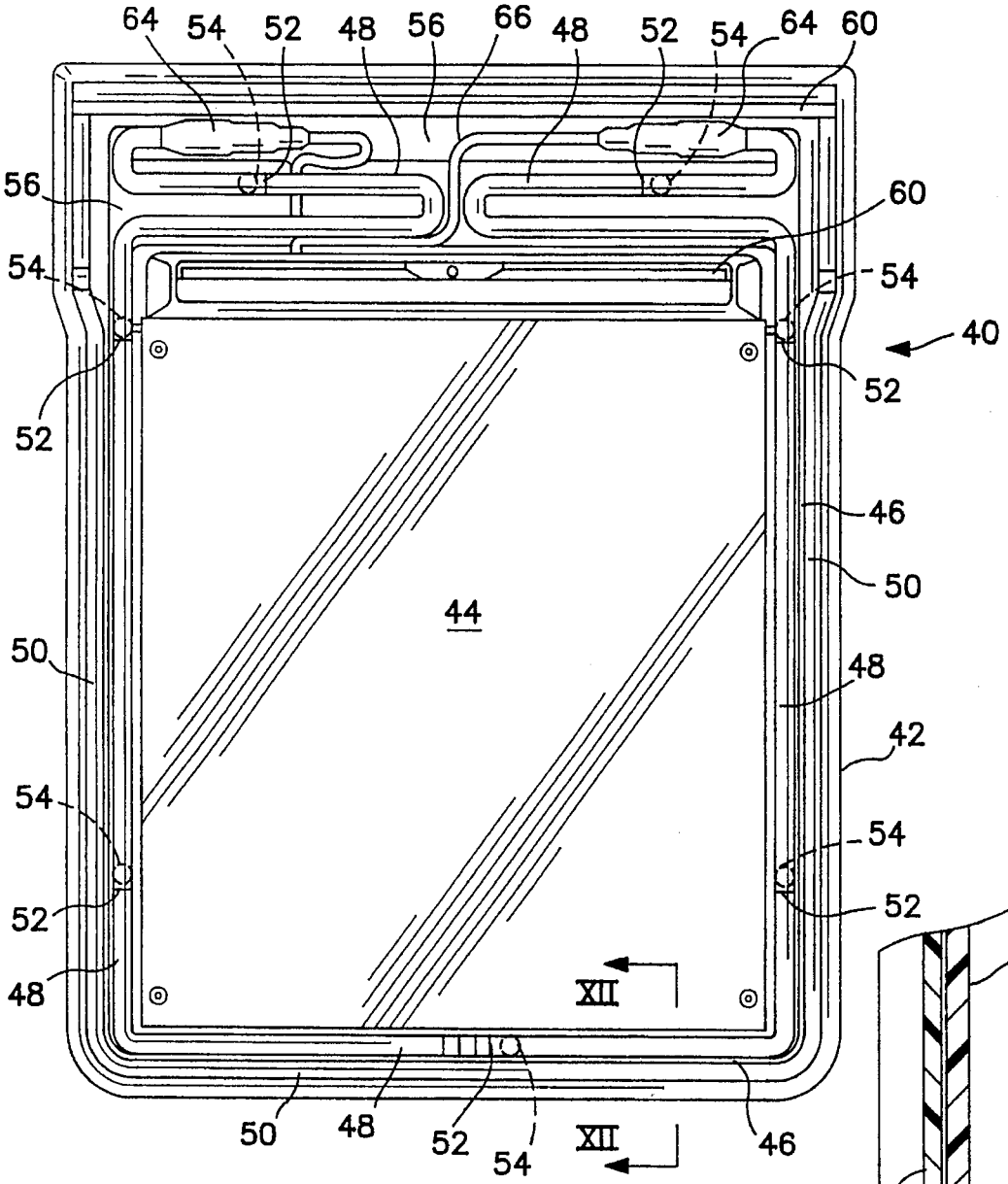
Figure 12:
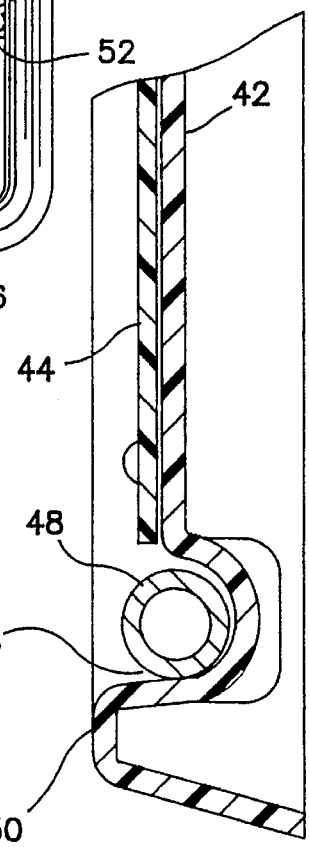

FIG. *7a* is an enlarged, broken-away, sectional view of a groove portion of the unit shown in FIG. 1 taken generally along line VII—VII looking in the direction of the arrows thereof, and showing the position and mounting of the glass tubing in a groove of the display unit;

FIG. *7b* is a broken-away, sectional view of a groove portion of the unit, as in FIG. *7a*, but showing alternate means for mounting the glass tubing in a groove of the display unit;

FIG. 8 in an enlarged, sectional view of the display unit of FIG. 1, taken generally along lines VIII—VIII looking in the direction of the arrows thereof, and showing internal components of the unit;

FIG. 9 is a front elevation view of another embodiment of the electrical luminous display unit of the present invention;

FIG. 10 is an enlarged, sectional view of the display unit of FIG. 9 taken generally along lines X—X and looking in the direction of the arrows;

FIG. 11 is a front elevation view of the display unit of FIG. 9, with the front panel covering a compartment of the unit removed to show the interior thereof; and FIG. 12 is an enlarged, broken-away sectional view of a portion the unit of FIG. 11 taken along lines XII—XII and looking in the direction of the arrows thereof.

DETAILED DESCRIPTION OF PREFERRED EMBODIMENTS

Referring now more particularly to the drawings, FIGS. 1–8 show, in the various views, one embodiment of the present invention. As seen, the electrical luminous display unit 10 includes a support housing 12 having a front face portion 14, and a rear closure portion 16, both formed of suitably rigid opaque plastic, such as a molded polystyrene resin. The front face portion 14 contains one or more elongated grooves 18, 20 for the receipt and protection of elongated glass tubing 22 for containing an inert gas, such as neon, which may be electrified to illuminate the tubing to convey visual information through transparent portions thereof. As shown, the visual information consists of block letters forming the word "OPEN" surrounded by a generally rectangular border of glass tubing.

The glass tubing 22 for containing the inert gas is bent, as in a heat-shaping operation. In such shaping operation, a length of tubing, e.g., four feet, is suitably heated and bent in the shape of letters, e.g., OPEN. To separate and distinguish the letters, portions 22*a* of the length of tubing are bent to lie primarily in a plane separate from the plane of the letters of the message to be conveyed. These portions of tubing which are bent to lie in a separate plane, generally parallel to the plane of the letters, are called "transition" portions of the tubing. The transition portions 22*a* (FIGS. 4–6, and 8) are generally painted, or blacked out, to make them opaque and preclude passage of light therethrough.

End portions of the inert gas-containing tubing 22 are connected to electrodes 24 (FIGS. 6 and 8) which are in turn connected by electric wiring 26 to a transformer 28 which conventionally converts energy from a power source (not shown), such as a 110 V electric power supply, to high voltage energy. The gas in the tubing is thus energized in conventional manner to illuminate the tubing and transmit light through the transparent portions thereof.

As best seen in FIGS. 1, 7*a*, 7*b*, and 8, the portion of glass tubing 22 forming the visual information "OPEN" surrounded by the border tubing is received within and protected by grooves 18, 20 of generally semicircular cross-section which contain and surround a major portion of the glass tubing. The face portion 14 and grooves 18, 20 thus provide an opaque background for the illuminated tubing and concentrate the light emitted therefrom in a forward direction toward a viewer. Location of the tubing in the grooves also provides protection for the tubing. The tubing 22 is suitably mounted and retained in the grooves 18, 20 by suitable fastening means, such as a silicone adhesive 23 (FIG. 7*a*), thin copper attachment wires, or clips 25 (FIG. 7*b*) attached to the face portion 14 in the grooves 18, 20.

Figure 3:
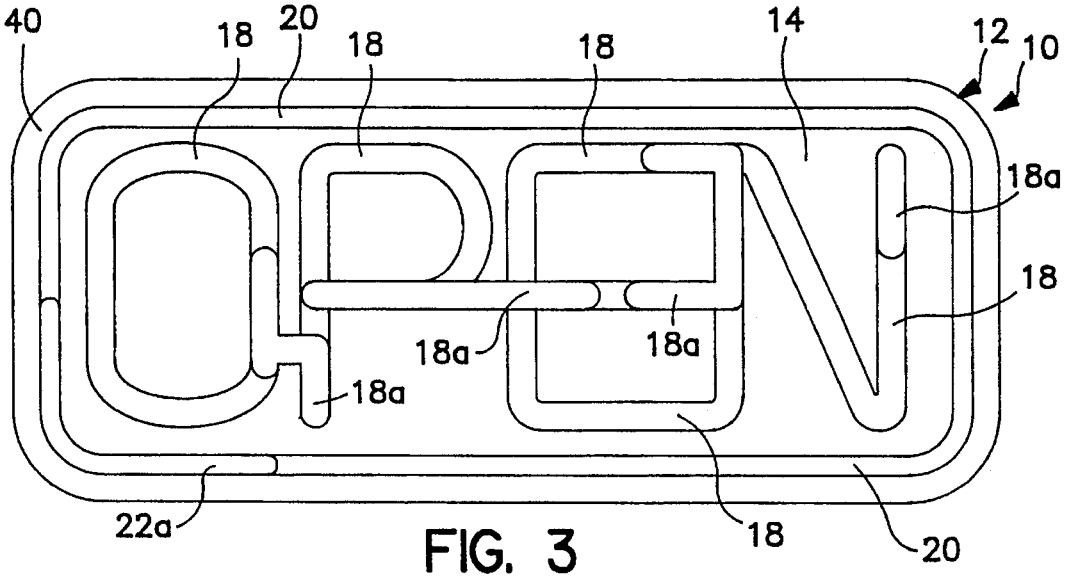
FIG. 3 is a front elevation view of the display unit of FIG. 1, with the glass tubing thereof removed to better show the grooves in and openings through the front face portion of the unit which receive and protect the tubing.
Figure 4:
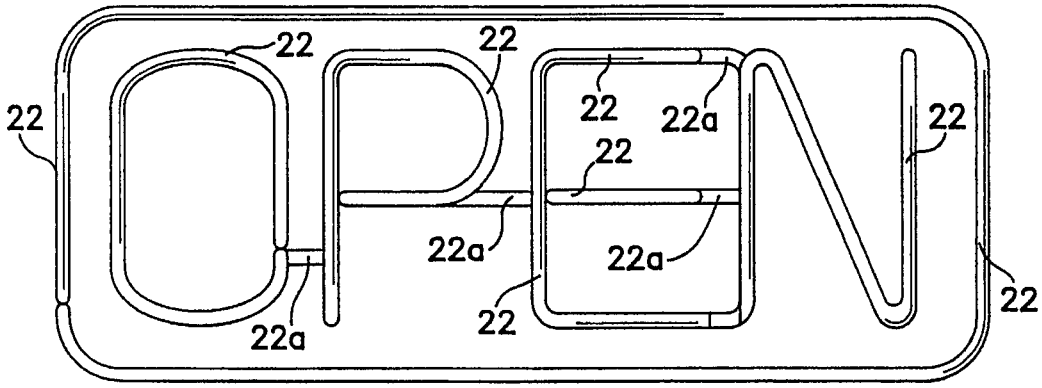
FIGS. 4 and 5 are front and rear elevation views, respectively, of the glass tubing, only, of the luminous display unit of FIG. 1.
Figure 5:
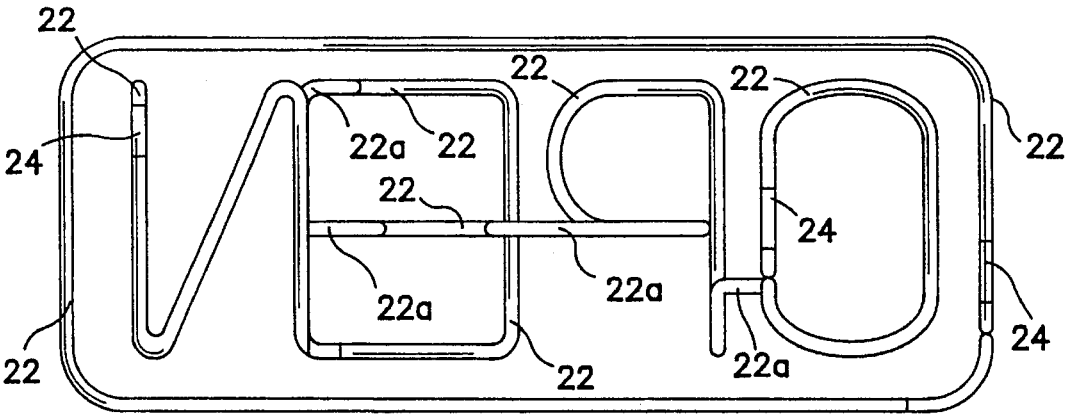
Figure 6:
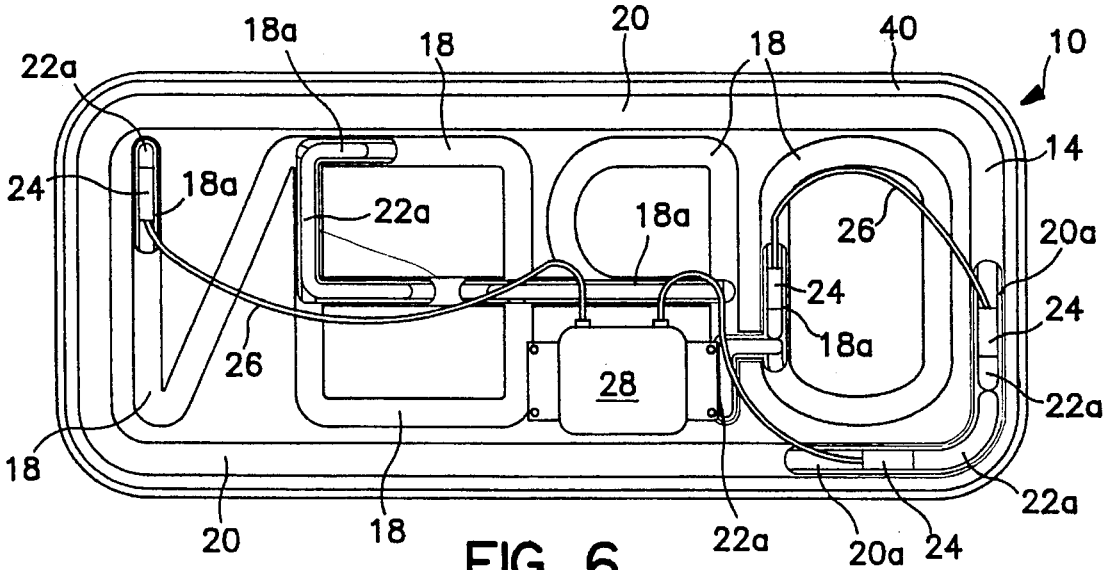
FIG. 6 is a rear elevation view of the front face portion of the unit of FIG. 1, with the rear closure portion of the housing removed, showing electrical components and openings in the front face portion for receiving portions of the glass tubing therethrough.

To protect and hide the transition portions 22*a* of the glass tubing which lie in a plane behind the plane of the letters "OPEN" and inside the housing 12, portions of the grooves 18, 20 of the front face portion 14 of the unit 10 have elongated openings 18*a*, 20*a* therethrough (see FIGS. 3 and 6). These openings receive the transition portions 22*a* of the glass tubing therethrough for retention in the housing 12 of the unit, along with the electrical wiring 26, electrodes 24, and transformer 28 (see FIG. 8).

The rigid molded front face of the unit may be attached to the rear face by suitable means, such as fastening screws 29 spaced about the periphery of the unit. If desired, for outdoor use of the display unit, the face of the unit may be further protected by a transparent cover 30 (FIG. 8).

Figure 7A:
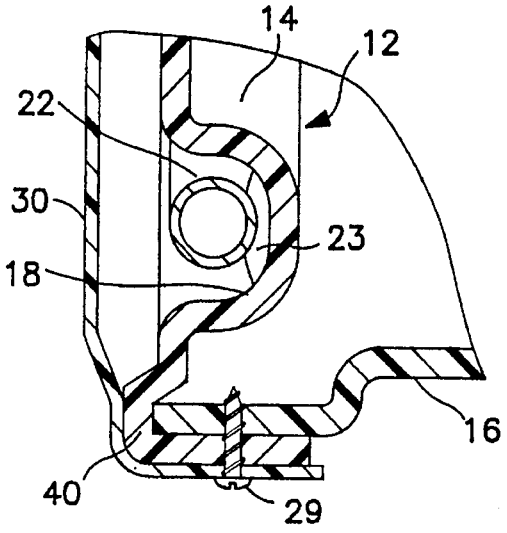
Figure 7B:
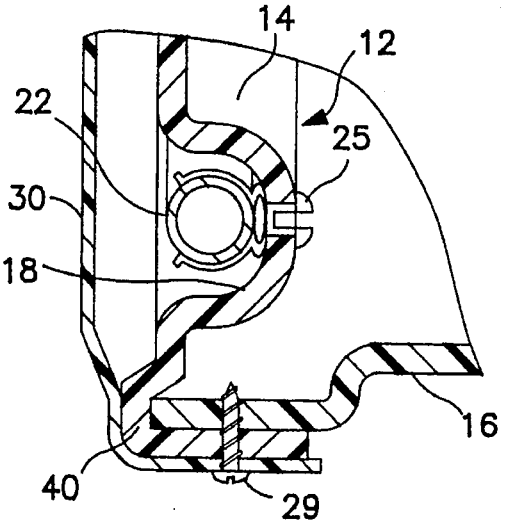

FIGS. 7*a*, 7*b*, and 8 more particularly show the location and an arrangement for support of the glass tubing 18, 20 in the grooves by suitable adhesive 23 (FIG. 7*a*) or spring clip 25 (FIG. 7*b*). As seen, the groves are so dimensioned as to receive the full diameter of the tubing therein, thus protecting the tubes while emitted light from the tubes is concentrated in a forward-facing direction for view by the human eye.

Thus it can be seen that the display unit of FIGS. 1–8 provides a simplified, economical arrangement for supporting and protecting glass tubing and electrical components of a neon-type display sign, while providing improved visualization of the displayed information therefrom.

FIGS. 9–12 show a modified form of illuminated display unit of the present invention wherein the unit is in the form of an edge-lighted, information board for illuminating hand written information or other indicia thereon. In this embodiment, the display unit 40 comprises a support housing 42 consisting of an opaque sheet of suitably rigid plastic, such as a molded polystyrene resin, which is shaped as a front face portion to provide a flat central surface for receipt and support of a light-transmitting board 44 of rigid material, such as an acrylic plastic, on which information may be written by hand or by the placement of suitable indicia. The board 44 may have an opaque paint on its back face to facilitate light transmission through its front face.

As seen, surrounding the periphery of three sides of the rectangular board 44 and located in a continuous groove 46 in the peripheral portion of support housing 42 is an inert gas-containing glass tubing 48. As seen in FIGS. 10 and 12, the glass tubing 48 is received within peripheral groove 46 of the housing to lie approximately in the plane of the transparent display board 44 so as to provide edge lighting thereto, as well as to project border lighting of the board toward the viewer, while residing within the groove and below a peripheral rim 50 of housing 42 to be protected thereby. The tubing may be suitably supported in the groove, as by copper tie wires 52, and is spaced from the bottom of the grooves by spacer pads 54 of felt or the like. Alternatively, the tubing may be attached to the front face portion of the housing by adhesive or spring clip, as in the case of the tubing in the embodiment of FIGS. 1–8.

Located in the upper peripheral edge portion of the housing 42 is an elongated compartment 56 (FIG. 11), a front panel 58 (FIG. 9) which is slidingly received in grooves 60 to enclose end portions 52 of the glass tubing 48, electrodes 64, wiring 66, and a transformer 68 (FIG. 10) which supplies power to the unit. As seen in FIGS. 10 and 11, the housing compartment 56 is divided by a midwall 70 on which is supported the transformer 68 and a portion of the rear of the housing compartment is enclosed by a removable backplate 72.

As best seen in FIG. 12, the glass tubing 48 providing edge-lighting to the transparent display board 44 of the unit is recessed within the groove 46 with the rim 50 of the support housing providing additional protection for the tubing. Thus a continuous piece of glass tubing may be bent and shaped to not only provide edge-lighting and border lighting for the display board, but to back-light the front panel 58 of the compartment 56 on which more permanent visual information may be displayed, e.g., "SPECIALS", as seen.

Thus it can be seen from the foregoing detailed description of the disclosed embodiments, the present invention provides an electrical illuminated display unit of simplified and economic construction in which the illuminated tubing and electrical components of the unit may be supportably maintained within grooves of a molded plastic support housing and wherein the grooves and housing provide tubing protection and an opaque background to concentrate light emitted therefrom in a forward direction for viewing by an observer.

That which is claimed is:

1. An electric luminous display unit for conveying visual information including a housing comprising an opaque front face portion of substantially rigid molded plastic, an elongated groove in the front face portion, inert gas-containing glass tubing located in the groove and extending therealong, fastening means for supportably retaining the tubing in the groove, and electrical means connected to ends of the glass tubing for supplying electrical energy to illuminate said glass tubing whereby light from the tubing in the groove is directed forwardly from the front face portion for viewing by the human eye;

wherein the face portion is shaped to define a compartment extending along a side of said unit, an at least partially translucent front panel encloses said compartment, and portions of said glass tubing including said ends of said glass tubing extending from said groove into said enclosed compartment and under said front panel for illuminating said front panel of the enclosed compartment.

2. A display unit as defined in claim 1 wherein said front panel of the compartment includes indicia thereon for illuminated viewing by the human eye.

3. A display unit as defined in claim 2 including a board of light-transmitting material attached to the front face portion and having a front surface for receiving hand written indicia thereon, and wherein said tubing in said groove surrounds a major peripheral edge portion of the board to transmit light into the board to illuminate the hand written indicia thereon for viewing by the human eye.

4. A display unit as defined in claim 3 wherein said compartment extends along a first portion of the peripheral edge portion of the board, and said tubing in said groove extends along a remaining peripheral edge of the board.

5. A display unit as defined in claim 1 wherein said portions of said glass tubing extending into said enclosed compartment and under said front panel extend under a center portion of said front panel.

* * * * *